US005433627A

United States Patent [19]

Guerra et al.

[11] Patent Number: 5,433,627

[45] Date of Patent: Jul. 18, 1995

[54] GROUNDING BRANCH CONNECTOR FOR COAXIAL CABLE

[76] Inventors: Ricardo Guerra, 4455 N. New Castle, Hardwood Heights, Ill. 60656; Alfred Salazar, 17406 S. 92nd East Ave., Bixby, Okla. 74008

[21] Appl. No.: 109,661

[22] Filed: Aug. 20, 1993

[51] Int. Cl.[6] ..... H01R 9/07

[52] U.S. Cl. ..... 439/582; 439/394

[58] Field of Search ..... 439/389, 391, 394, 395, 439/402, 403, 63, 581, 582; 29/828, 33 M, 747, 748

[56] References Cited

U.S. PATENT DOCUMENTS

| | | | |
|---|---|---|---|
| 3,543,222 | 11/1970 | Rheinfelder | 439/394 |
| 4,691,976 | 9/1987 | Cowen | 439/828 |
| 5,076,799 | 12/1991 | Virgo | 439/394 |

FOREIGN PATENT DOCUMENTS

| | | | |
|---|---|---|---|
| 0121958 | 10/1984 | European Pat. Off. | 439/394 |
| 0122577 | 5/1989 | Japan | 439/394 |
| 0289073 | 11/1989 | Japan | 439/394 |

*Primary Examiner*—David L. Pirlot

[57] ABSTRACT

A method and apparatus for connecting, in an intermediate place and without cutting it, to a coaxial cable wherein an oblong section of the outer insulation is sliced out and the outer conductor is moved away discovering the inner insulation. The central conductor is connected with an electrical conductor which has one end forked, adapted to penetrate the inner insulation. The other end has a tubular shape, adapted for the insertion of the central contact of a coaxial connector, and it is insulated in it's outside surface to avoid electrical contact with a second part which provides the electrical connection of the outer conductor. The second part is a tubular metallic housing, externally threaded to screw into a standard coaxial connector, one end has a constriction, reducing the internal and external diameter, with the purpose to facilitate the insertion in the coaxial connector and to provide an internal shoulder that holds the insulated central conductor. The other end has two projecting pins diametrically opposed, adapted to penetrate the external insulation and electrically contact the outer conductor of the coaxial cable. A plastic jacket with self locking borders keeps the coaxial cable securely attached to the electrical contacts.

4 Claims, 4 Drawing Sheets

GROUNDING BRANCH CONNECTOR FOR COAXIAL CABLE

BACKGROUND OF THE INVENTION

1. Field of the Invention

This invention relates to a branch connector for coaxial cable and, more specifically, to a method and solderless apparatus for connecting to a coaxial cable with provision for a ground connection.

2. Description of the Prior Art

Due to the increase in the use of multiple TV sets and video monitors connected to a single signal source, as in the case of master antennas for TV and FM, video security systems, satellite TV systems, cable television and computer terminals, need has arisen for a reliable branch connector for coaxial cable. One of the most popular devices for branching coaxial cable is the well-known "splitter". This T-shaped interconnection element has three or more coaxial threaded terminals, with one terminal usually used as an input and the others as outputs. Splitters are strong in construction, are well adapted to be fastened to the wall and they have a grounding terminal. However, its installation require to cut the main trunk line and provide each end with a coaxial plug. This procedure short-circuits the cable by the cutting tool, interrupts the signal to the rest of the circuit, which is not desirable for lines in use and is fairly time-consuming and expensive. Another disadvantage of splitter is that they are not well adapted for in-conduit installations.

To overcome some of the above described disadvantages, other branch connectors have been disclosed by the prior art for electrically and mechanically providing a connection to a coaxial cable. Examples of these efforts are U.S. Pat. No. 4,624,520, U.S. Pat. No. 4,775,329, U.S. Pat. No. 4,365,859, and U.S. Pat. No. 4,469,391. With these connectors, the main trunk lines do not have to be cut off, avoiding the interruption of the signal, and avoiding the work and cost of installing coaxial plugs at each end of the cable as in the case with the splitter. This is achieved by the use of insulation piercing pins or forked contacts, which are driven by different means into the coaxial cable. However, the versatility of these devices is objectionable since most of them are dedicated for specific applications. Some of these branch connectors do not have provisions for a grounding connection, are not well adapted for in-conduit installations and/or outside installations where the cable is attached to the wall.

OBJECTS OF THE INVENTION

An object of the present invention is to provide a novel branch connector for coaxial cable which requires no special tools and can be installed by semi-skilled personnel or the general public in a rapid and simple manner.

It is a more particular object of the present invention to provide a versatile general purpose coaxial branch connector adapted for in-conduit or outside installations. Still another object of the present invention is to provide a coaxial branch connector with provision for a ground connection which can be used as a grounding block. Yet another object of the present invention is to provide a coaxial connector which does not require to short-circuit or cut off the cable during installation.

Still yet another object of the present invention is to provide a coaxial connector wherein the resulting connection is both mechanically and electrically reliable.

A further object of the present invention is to provide a coaxial branch connector which is easy and inexpensive to manufacture.

SUMMARY OF THE INVENTION

According to the present invention, a method and apparatus is provided for branching, in an intermediate place, to a coaxial cable through a standard terminal connector.

The central conductor of the coaxial cable is connected with an electrical conductor which has one end forked, adapted to penetrate the insulation of the coaxial cable, and has it's outside surface insulated with varnish to avoid short-circuiting the outer conductor with the central conductor. The varnish insulating process is well know in the art and is widely used in the insulation of electric coils and armatures of electric motors, and one of it's characteristics is that it provides a thin insulating film that is hard and smooth. The other end of the electrical conductor has a tubular shape, adapted for the insertion of the central contact of an end connector, and has an outside thick plastic insulation to facilitate it's handling during it's installation and to avoid any electrical contact with a second part which provides the electrical connection to the outer conductor of the coaxial cable.

The second part is a tubular metallic housing, which is telescopically installed over the insulation of the central electric conductor, and most of it's external surface is threaded so that it may be screwed into a standard end-terminal connector. The threaded end has a constriction, reducing the internal and external diameter with the purpose to facilitate the insertion in the coaxial end-terminal connector and to provide an internal shoulder that holds the insulated central conductor inside of the housing. Close to the other end of the tubular housing, the thread finish on a circular ring provides an electrical grounding contact for in-conduit installations and stops the housing from being driven out of the branch connector by pulling forces. In the end of the tubular housing are two projecting pins, diametrically opposed, adapted to penetrate the external insulation and electrically contact the outer conductor of the coaxial cable. These two projecting pins are sharp enough to be hand driven through the insulation, and they have a circular section to avoid damage to the internal insulation, since these pins also have the function of opposing the twisting force of the end-terminal being threaded onto the branch connector. Between the projecting pins and the circular ring, four transversal grooves provide an anchoring means for the attaching jacket. The tubular housing is firmly attached to the coaxial cable by a tubular, resilient plastic jacket, which has a longitudinal opening with self locking borders and two central opposing notches that interlocks the grooves of the outer conductor housing.

A metallic strip, with three holes of similar diameter of the outside diameter of the housing connector, and a smaller hole in each end, is used for grounding purposes on in-conduit installations.

The threaded housing terminal is passed through one hole of the grounding strip, then through the hole of a plastic cover plate and the assemblage is secured with a nut. The screws that attach the cover plate to the electric box pass through the small hole of the grounding strip making electrical contact with the electric box which is supposed to be grounded. If a metallic cover plate is used, the grounding strip will be unnecessary, since the cover itself will provide a grounding connection to the electric box, however, if the grounding connection is not desired, an insulating washer will be installed between the metallic plate and the branch connector. For outside installations the grounding strip and the cover plate is replaced with a U-shaped metal bracket which reinforces the assemblage and is adapted for attaching the branch connector to the wall with two screws. One of the screws can be used as a grounding terminal if required. The same U-shaped bracket will be used on outside installations hanging from a wire, using a U-bolt with two nuts.

The branch connector of the present invention is intended to be used in three different ways. First as a branch connector to provide a branch connection to an unbroken portion of a coaxial cable. Secondly, as a 90° end connector to be installed at the end of a coaxial cable, and lastly, as a grounding block.

DESCRIPTION OF THE PREFERRED EMBODIMENT

Figure 1:
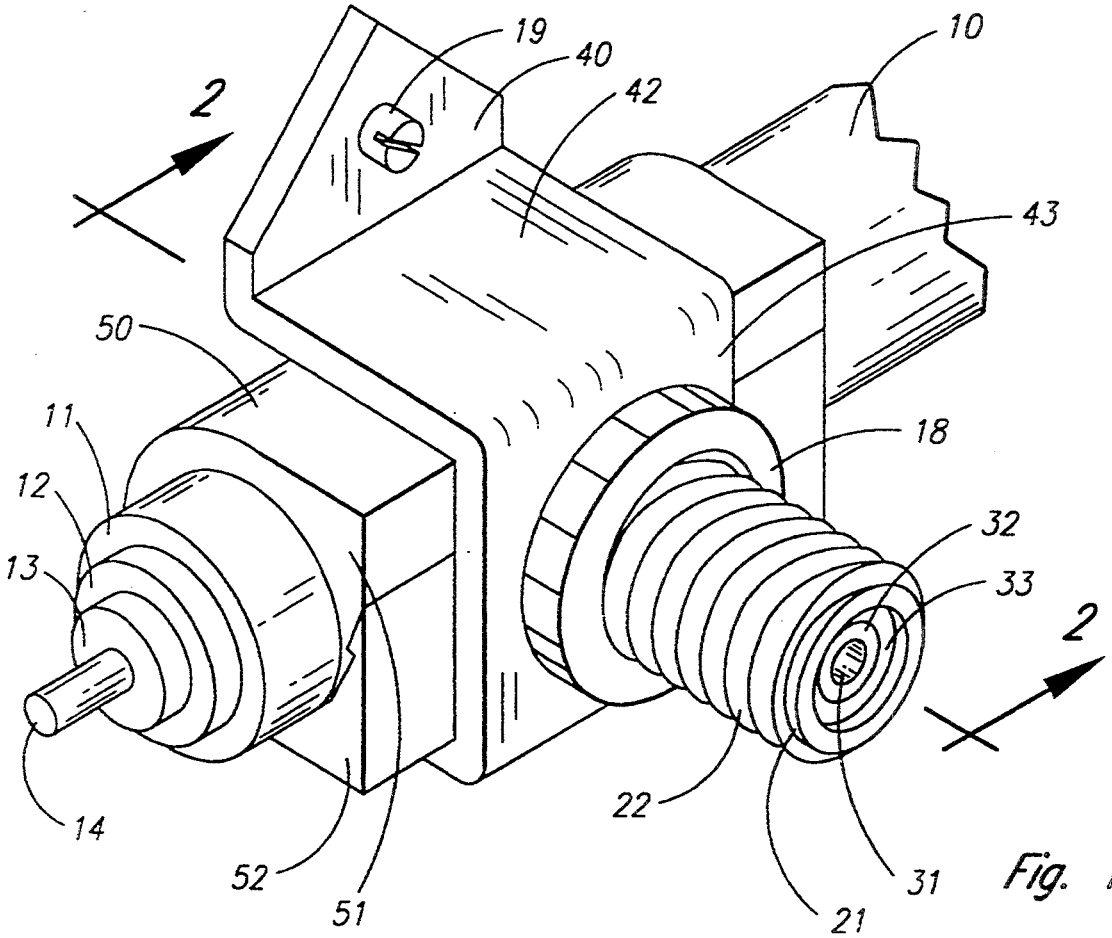
FIG. 1 is a perspective view of one embodiment of the branch connector of the present invention with a section of coaxial cable for illustration purposes.
Figure 2:
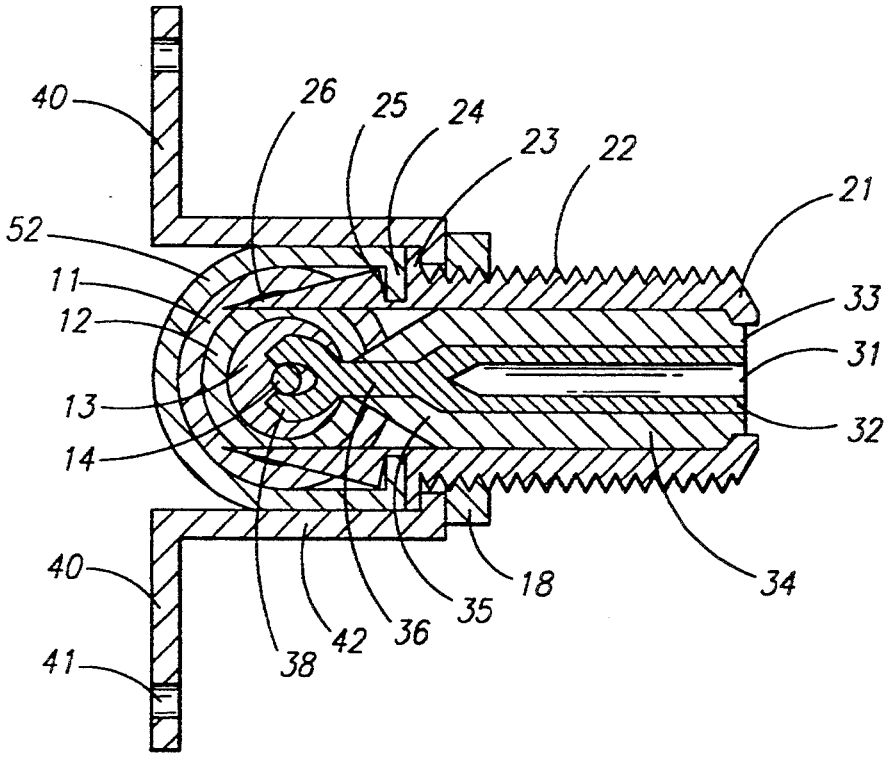
FIG. 2 is a cross-sectional view of the branch connector of the present invention, the plane of the view being indicated by line 2—2 in FIG. 1.
Figure 3:
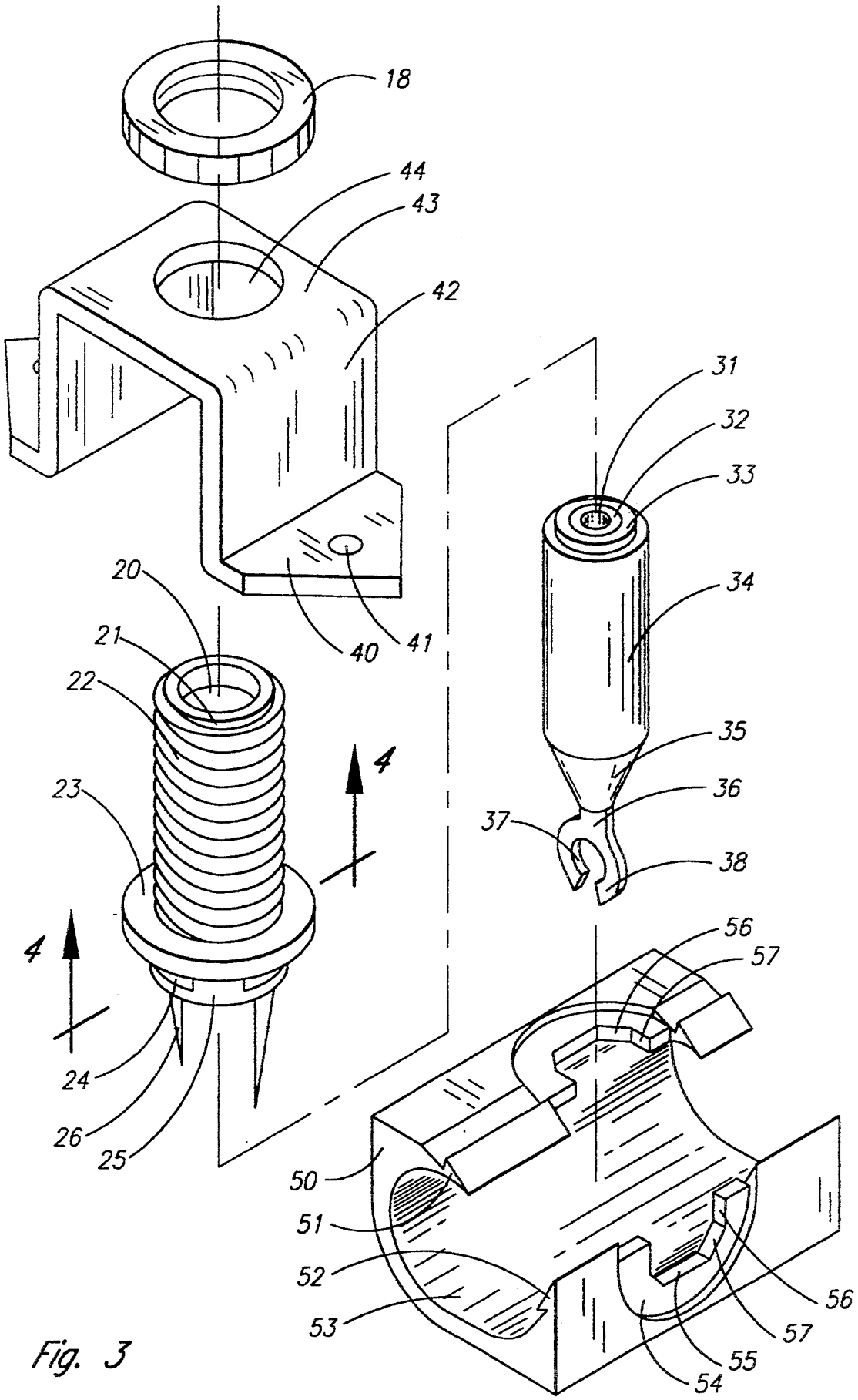
FIG. 3 is an exploded perspective view of one embodiment of the branch connector according to the present invention.

FIG. 1 shows a preferred embodiment of the branch connector according to the present invention, branching a coaxial cable 10.

The coaxial cable 10 to 14 is not an inventive feature, since the branch connector of the present invention is intended to be used with commercial coaxial cable with two conductors. This cable 10 has a central conductor 14 which is usually made of a single wire or a cable of multiple conductors. The central conductor 14 is encircled by a dielectric insulation layer 13, which in turn is encircled by an outer conductive shield 12, usually consisting of a metallic braid or a metallic foil. The conductive shield 12 is encircled by a flexible insulating jacket 11 which provides mechanical and electrical insulation to the conductive shield 12. To facilitate the installation of the branch connector on the coaxial cable 10, a transversal V-shaped notch (not shown) is made in the insulating Jacket 11 using an utility knife or a diagonal plier (side cutter), avoiding the central conductor 14 which has a diameter many times smaller than the diameter of the insulating jacket 11. The above mentioned procedure will remove an oblong section of the insulating jacket (not shown) and a section of the conductive shield 12. If strands of the conductive shield 12 remain, crossing the groove, they will be moved away, discovering the inner insulation 13, to end the pre-work of the coaxial cable.

The central conductor of the coaxial cable 14 is connected with an electrical conductor 31 to 38, which has one end forked 38, adapted to penetrate the inner insulation 13 and interlock with the central conductor 14 by a "snap-action", providing a mechanical and electrical connection.

To avoid short-circuiting the conductor shield 12 with the central conductor 14, the surface of the fork 36 and 38 is insulated with varnish, with the exception of the inner surface of the fork 37, which provides the electrical connection.

The other end of the forked conductor 32 has a tubular shape that can include three or more longitudinal grooves and its central section slightly bent inward like leaf springs (not shown), adapted for the insertion of the central contact of a standard "F" connector (not shown) through the central opening 31.

This tubular section 31 and 32 is encapsulated in a heavy plastic insulation 33 to 35 which serves three purposes; first, it provides electrical insulation, second, it holds and keeps the central conductor in a centered position respective to the tubular housing 34 of the second conductor, and third, it facilitates it's handling during it's installation on the coaxial cable 10, since the forked end 38 is driven through the dielectric insulation 13 by finger pressure.

One end of the plastic insulator 35 has a conical shape that reinforces the blade 36 between the forked connector 38 and the tubular connector 32 of the central conductor. This conical section 35 fits in the groove made on the coaxial cable.

The conductive shield 12 of the coaxial cable 10 is connected with a second electrical conductor 20 to 26, which has a tubular shape and is telescopically installed over the insulation 34 of the central conductor 32.

The conductive shield's connector has most of it's external surface threaded 22 to accept an "F" end connector. The threaded end has a constriction, reducing the internal 20 and external 21 diameter, with the purpose of facilitating the insertion of the "F" end connector (not shown) and to provide an internal shoulder 21 that holds the insulation 34 of the central conductor. The insulation 34 of the central conductor has a reduction in diameter in the end 33 which partially enters the opening 20 of the conductive shield connector. The threads of the conductive shield connector 22 end on a circular ring 23 which provides a grounding contact for a grounding connection when desired and stops the conductive shield connector from being driven out of the branch connector by pulling forces. In the second end of the shield connector are two projecting pins 26, diametrically opposed, adapted to penetrate the insulating jacket 11 and electrically contact the conductive shield 12 of the coaxial cable 10. These two projecting pins 26 are sharp enough to be driven through the insulating jacket 11 with finger pressure and they have a circular section to avoid damage to the dielectric insulation 13, since these pins also have the function of opposing the twisting force of the "F" connector being threaded onto the branch connector of the present invention. Between the projecting pins 26 and the circular ring 23, four transversal grooves 24 provide an anchoring means for the attaching jacket. The conductive shield connector 20 to 26 is firmly attached to the coaxial cable 10 by a tubular resilient plastic jacket 50 to 57, which has a longitudinal opening with self-locking borders 51 and 52. Each border has a semicircular recess 54 which holds most of the circular ring 23 on it, and a notch 55 to 57 that encircles the shield connector when the attaching jacket is closed over it. Each notch has an almost semicircular shape, with straight sections 55 and 56 adapted to enter the groves 24 of the shield connector when the attaching jacket is closed over it.

It will be readily understood by those skilled in the art that an attaching jacket, with multiple notches to hold more than one shield connector, can be manufactured to form a branch connector with more than one outlet terminal on it. It has to be noted that even if the first preferred embodiment of the present invention describes a branch connector with an "F" outlet terminal, the specific embodiment disclosed herein may be readily utilized as a basis for modifying or designing other structures for carrying out the same purposes as those of the present invention. Furthermore, those skilled in the art can realize that such equivalent constructions do not depart from the spirit and scope of the invention as set forth in the claims.

The branch connector of the present invention can be used on a free hanging coaxial cable, can be attached to the wall, or used on in-conduit installations. FIG. 1 shows the branch connector attached to the wall with a U-shaped metal bracket 40 to 44. The metal bracket has a central section 43 with a hole 44 that allows the insertion of the shield connector till the circular ring 23. A nut 18, threaded on the shield connector, holds the branch connector to the U-shaped bracket, which has two flaps 40 with a hole 41 for a mounting screw 19 (FIG. 1). One of these screws (only one is shown) can be used for grounding purposes since the metallic U-shaped bracket is in contact with the circular ring 23. The two mounting screws 19 can be replaced by a U-bolt and two nuts (not shown) on outside installations hanging from a support wire.

Figure 5:
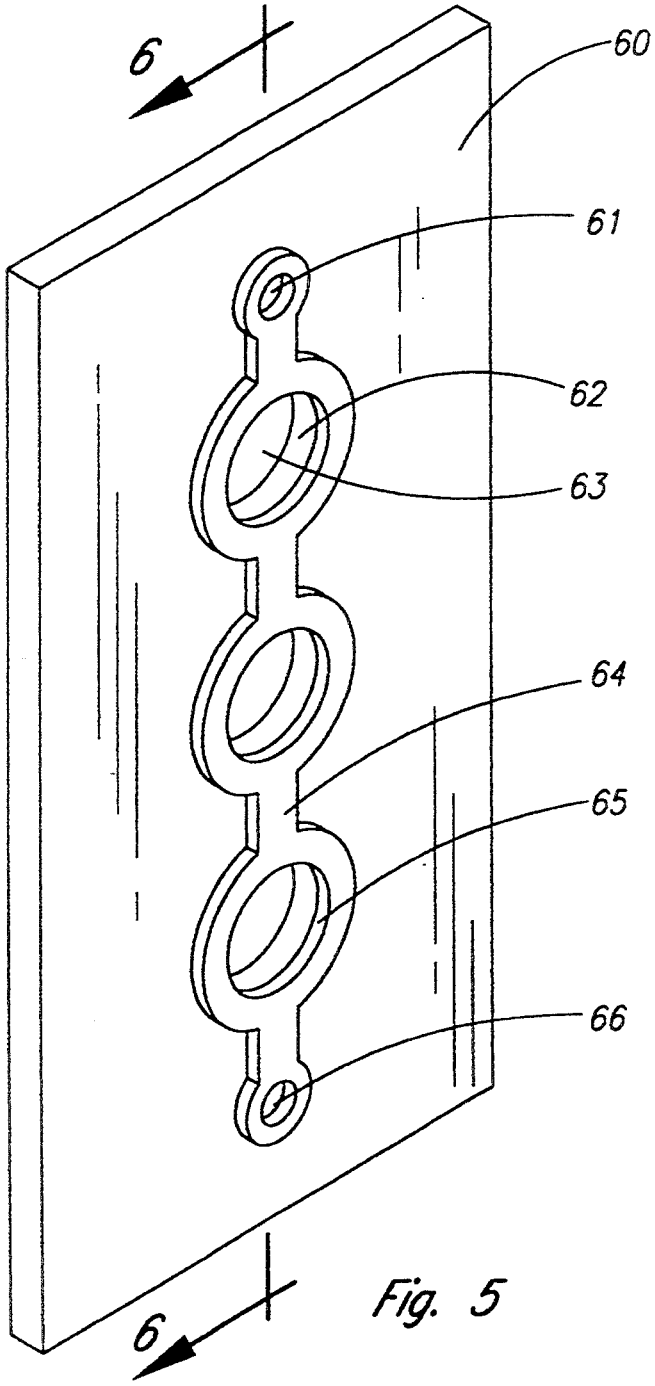
FIG. 5 is a plastic cover plate with a perforated metallic grounding strip for in-conduit installation of the branch connector of the present invention.
Figure 6:
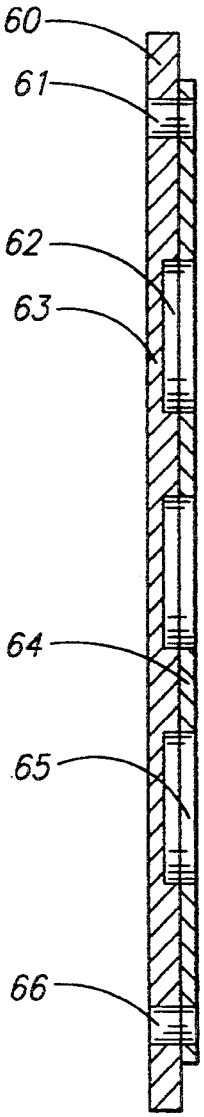
FIG. 6 is a cross-sectional view, the plane of the view being indicated by line 6—6 in FIG. 5.

For in-conduit installations, the U-shaped bracket is replaced by a plastic cover plate (see FIGS. 5 and 6) with a grounding strip 64. This plastic cover plate 60 is adapted for the installation of one, two, or three branch connectors. The reverse of the plate has three circular recesses 62, with a thin membrane 63 which can be removed with a screw-driver to make an opening to insert the shield connector of the branch connector of the present invention.

Figure 7:
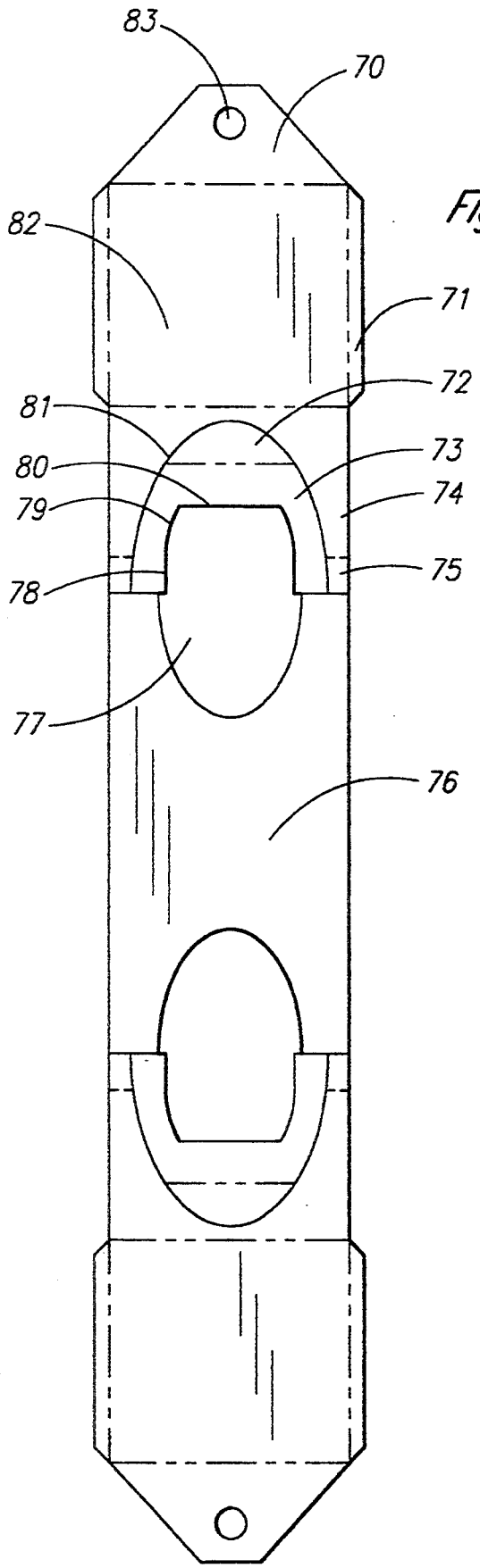
FIG. 7 shows a flat sheet, stamped from metal to form an attachment clamp.

The cover plate 60 and the grounding strip 64 have two holes 61 and 66, for two mounting screws that attach the cover plate 60 to the electric box (not shown) which is supposed to be grounded. If a metallic cover plate is used (not shown), the grounding strip 64 will be unnecessary since the cover itself will provide the grounding connection to the electric box. In a second preferred embodiment of the present invention, the attaching jacket 50–56, and the U-shaped bracket 40–44 are replaced by an attaching clamp (see FIG. 7–FIG. 9) which is formed from a single sheet of a highly resilient metal (FIG. 7) as steel.

Figure 8:
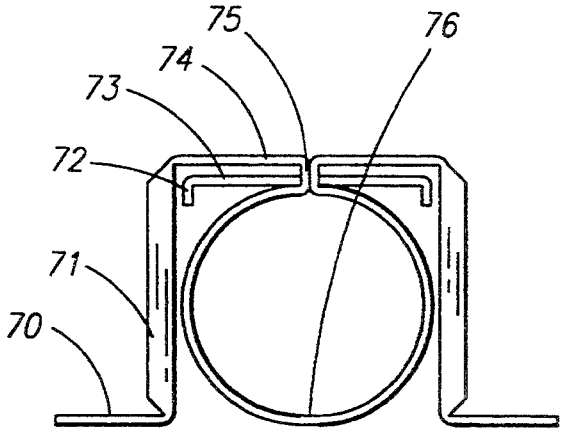
FIG. 8 shows a front elevation of the attaching clamp, formed with the sheet of FIG. 7, in it's closed released position.
Figure 9:
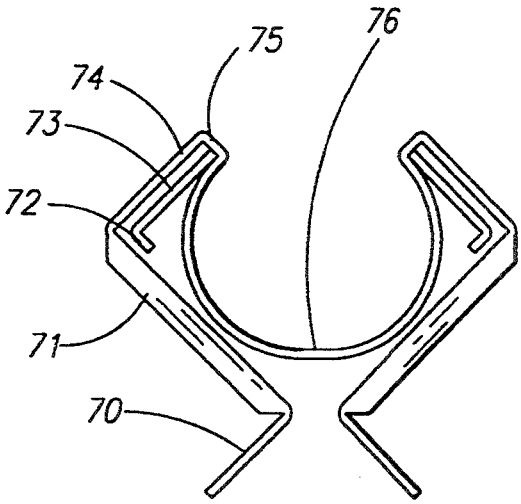
FIG. 9 shows a front elevation of the attaching clamp of FIG. 8 in it's open position.

Since the stamped sheet has a transversal symmetrical geometry, each feature is repeated at each side of an imaginary transversal axis and each side is cut and bent in the same way to form the attaching clamp FIG. 8 of the second preferred embodiment of the present invention.

For the above mentioned reason, only one side of the transversal axis will be described to avoid unnecessary repetition. The ends 70 form the base of the attaching clamp, they have a circular hole 83 to receive a fastener (not shown) which can be used to attach the clamp to the wall on outside installations and/or to make a grounding connection (not shown).

Figure 4:
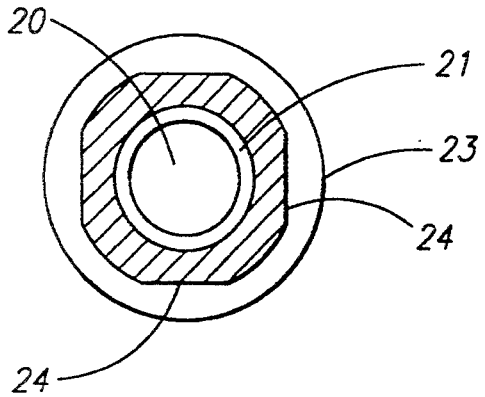
FIG. 4 is a cross-sectional view, the plane of the view being indicated by line 4—4 in FIG. 3.

The legs of the clamp 82 have two flaps 72 which are bent through the pointed lines 180° to avoid sharp edges and reinforce the legs 82 that work as first class levers to open the clamp (see FIG. 9) allowing the introduction of the coaxial cable 10 with the central conductor and the shield connector 20–26 installed on it. The upper sections 74 have a semi-circular cut 81 which provide room for the shield connector's ring 23. An oblong hole 77 provides an opening for the lower parts of the shield connector 24–26. Between the oblong hole 77 and the semi-circular cut 81 are formed the inside jaws 73 of the clamp which have a semi-circular shape 79 with straight lines 80, 78 to interlock the shield connectors grooves 24 (see FIG. 4). Since the inside jaws 73 are bent on the lower line of the outside jaws 75, they are longer than the upper sections 74. For that reason a flap 72 is bent on it to reduce it's length and to provide rigidity. The central section 76 is rolled to form a circle with inside dimensions similar to the outside dimensions of the coaxial cable 10. Those skilled in the art can readily appreciate that the attaching clamp described above can be used with little modification to attach coaxial cable to a hanging wire, to the walls, to an equipment cabinet or circuit board.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. Apparatus for forming a branch connection to a co-axial cable, the coaxial cable having a central conductor surrounded by a tubular insulation around which is received a tubular conductive shield which in turn is covered with a tubular outer insulative jacket, the coaxial cable being prepared to receive a branch fitting by a V-shaped notch cut in the outer insulative jacket, and the tubular conductive shield to expose the tubular insulation having the central conductor therein, the apparatus comprising:

an elongated metallic electrical connector having a forked first end providing a recess therein dimensioned to interlock with said coaxial cable central conductor by snap action and having a second end that is tubular and adaptable to receive a central conductor portion of a branch coaxial cable;

insulation covering the exterior of said electrical connector from the second end to adjacent said forked first end, said forked end of said electrical conductor being forcibly positionable in said V-shaped notch in said coaxial cable to engage said forked end with said central conductor;

a tubular metallic conductive shield connector member for telescopically receiving said electrical connector and said insulation covering thereon, the conductive shield connector member having, at a first end thereof, integral, spaced apart pointed projecting pins that, when the conductive shield connector member is positioned over said electrical connector, penetrate and make electrical contact with said tubular conductive shield of said coaxial cable; and means to retain said electrical connector with said insulation cover thereon received within said conductive shield connector member in position on said coaxial cable.

2. Apparatus for forming a branch connection to a coaxial cable according to claim 1 wherein said means to retain said electrical connector and said conductive shield connector member in position on said coaxial cable comprises:

a flexible non-conductive jacket member conformable around said coaxial cable, the jacket member having an opening therein as formed around said coaxial cable to receive said conductive shield connector member; and a bracket member shaped to receive said jacket member to retain said jacket member conformed around said coaxial cable.

3. Apparatus for forming a branch connection to a coaxial cable according to claim 1 wherein said means to retain said electrical connector and said conductive shield connector member in position on a coaxial cable comprises:

a flexible attaching clamp having spaced apart leg and clamping portions and bendable between an open position wherein said clamping portions are spread apart and a closed position wherein said clamping portion engage said conductive shield connector member to retain it and thereby said electrical conductor in position on a coaxial cable.

4. Apparatus for forming a branch connection to a coaxial cable according to claim 1 wherein said conductive shield conductor member is externally threaded and including:

nut means threadable on said externally threaded conductive shield conductor member to retain said conductive shield conductor member in a support member having an opening therethrough for receiving said conductive; shield support member.

* * * * *